US007721718B2

(12) United States Patent
Morris et al.

(10) Patent No.: US 7,721,718 B2
(45) Date of Patent: May 25, 2010

(54) SYSTEM FOR CONTROLLING AN AIR TO FUEL RATIO

(75) Inventors: Paul R. Morris, Broughton Astley (GB); Max B. Raymond, Peterborough (GB); Roger C. Adams, Stamford (GB); Stuart A. Edwards, Peterborough (GB); John R. Addison, Bourne (GB); Jonathan C. Booty, Stamford (GB)

(73) Assignee: Perkins Engines Company Limited, Peterborough (GB)

( * ) Notice: Subject to any disclaimer, the term of this patent is extended or adjusted under 35 U.S.C. 154(b) by 4 days.

(21) Appl. No.: 12/068,511

(22) Filed: Feb. 7, 2008

(65) Prior Publication Data

US 2008/0190399 A1 Aug. 14, 2008

Related U.S. Application Data

(60) Provisional application No. 60/900,096, filed on Feb. 8, 2007.

(51) Int. Cl.
*F02M 37/00* (2006.01)
*F02M 37/04* (2006.01)

(52) U.S. Cl. ..... 123/510; 123/511

(58) Field of Classification Search ..... 123/510, 123/511, 382, 383, 363, 364, 379, 389, 391; 137/511, 515, 517
See application file for complete search history.

(56) References Cited

U.S. PATENT DOCUMENTS

| | | | | |
|---|---|---|---|---|
| 2,763,253 | A * | 9/1956 | Murrah | 123/511 |
| 2,907,313 | A * | 10/1959 | Hebert | 123/382 |
| 4,176,641 | A * | 12/1979 | Perr | 123/390 |
| 4,727,839 | A * | 3/1988 | Bruhmann et al. | 123/383 |
| 5,653,257 | A * | 8/1997 | Johnston | 137/517 |
| 6,953,026 | B2 * | 10/2005 | Yu et al. | 123/510 |
| 2001/0003282 | A1 * | 6/2001 | Rumpf | 123/510 |
| 2006/0070665 | A1 * | 4/2006 | Schmitt et al. | 137/514.5 |

* cited by examiner

*Primary Examiner*—Mahmoud Gimie
(74) *Attorney, Agent, or Firm*—Finnegan, Henderson, Farabow, Garrett & Dunner

(57) ABSTRACT

A method of controlling an air to fuel ratio of an internal combustion engine may include receiving a request for a modification of a first flow of fuel to at least one combustion chamber, modifying the first flow of fuel in response to the request, receiving a first signal indicative of a first air supply condition, displacing a second flow of fuel in response to receiving the signal and controlling the modification of the first flow of fuel by the displacement of the second flow of fuel.

26 Claims, 3 Drawing Sheets

SYSTEM FOR CONTROLLING AN AIR TO FUEL RATIO

PRIORITY

This application claims priority to U.S. Provisional Patent Application No. 60/900,096 filed Feb. 8, 2007, which is incorporated herein by reference in its entirety.

TECHNICAL FIELD

This disclosure relates to the field of internal combustion engines and in particular, but not exclusively, to controlling air to fuel ratios for such internal combustion engines.

BACKGROUND

Modern internal combustion engines, such as turbo charged diesel engines are the subject of stringent emission requirements. One characteristic that features in such requirements is the amount of particulates or visible smoke that an engine emits during running. Many factors influence the amount of particulates that an engine may emit such as fuel quality, operating environment and engine characteristics such as air-to-fuel ratio, speed, load and transient behaviour. One particular reason of smoke generation may be the lack of sufficient combustion air charge during aggressive transient states. One example of such transient state may be a rapid demand for the increase of power output of the engine by an operator who decides to increase the engine speed from idle to full speed by suddenly depressing the accelerator pedal fully. Since the engine accelerates in a delayed fashion, for a short time too much fuel is injected in relation to the amount of air available for combustion, which causes an incomplete combustion and possibly a drop in temperature in the combustion chamber and hence an excessive smoke development. Significant reduction of visible smoke emitted by turbocharged diesel engines upon acceleration has been achieved over the years by pressure sensitive devices such as aneroid controllers. Aneroid controllers influence the amount of fuel delivered to the injected system depending on the inlet manifold or boost pressure.

U.S. Pat. No. 4,727,839 describes such an aneroid controller. The controller as disclosed describes a multi-spring control arrangement to attain an improved fuel regulating characteristic rather than just a standard performance characteristic. Although the controller is compact and allegedly provides an improved regulating characteristic over the prior art, the design is complicated and may be prone to failure. The system is based on a spring loaded diaphragm having a mechanical arrangement attached for actuating a mechanism in a fuel injection pump. The diaphragm is being actuated under the influence of intake air pressure. The forces generated by the pressurized intake air are fairly weak and the system connected to the diaphragm balancing the gas forces must therefore not offer much resistance. A light spring arrangement is therefore preferred which may also improve the responsiveness of the system in general. Furthermore, as the controller is a "dry" controller, a sealing arrangement has to be in place to prevent any fuel from traveling up from the fuel injection pump into the controller. Normal tear and wear of the system in combination with the resistance offered by the sealing arrangement may hinder a proper operation of the controller.

The current disclosure is aimed at improving or overcoming at least some of the aforementioned disadvantages.

SUMMARY OF THE INVENTION

In a first aspect of the current disclosure there is provided a fuel system for an internal combustion engine comprising a boost control arrangement operably connectable to a fuel injection pump. The boost control arrangement has a first chamber and a second chamber separated from the first chamber by a moveable member. The first chamber is configured to receive a signal indicating a boost condition of the internal combustion engine. The second chamber is configured to contain fuel. The internal combustion engine further includes a fluid holding region fluidly connected with the second chamber and a fluid flow control arrangement between the second chamber and the fluid holding region for controlling the flow rate of fuel between the second chamber and the low pressure area.

In another aspect of the current disclosure there is provided a method of controlling an air to fuel ratio of an internal combustion engine. The method comprises receiving a request for a modification of a first flow of fuel to at least one combustion chamber and modifying the first flow of fuel in response to the request. The method further includes receiving a first signal indicative of a first air supply condition, displacing a second flow of fuel in response to the signal and controlling the modification of the first flow of fuel by the displacement of the second flow of fuel.

In yet another aspect of the current disclosure there is provided a valve arrangement for controlling flow rates into and out of a boost control arrangement of an internal combustion engine. The valve arrangement comprises a housing having a first passage portion and a second passage portion, a self-adjusting valve member slidingly engaged with said housing and positioned between the first passage portion and the second passage portion. The self-adjusting valve member has a first fluid passage fluidly connecting the first portion and the second portion of the housing. The valve arrangement further includes a second passage capable of fluidly connecting the first passage portion and the second passage portion of said housing, with the housing and the valve member being configured such that the self-adjusting valve member can adopt a position relative to the housing whereby in that position the second passage is restricted.

Other features and aspects of this disclosure will be apparent from the following description and the accompanying drawings.

DETAILED DESCRIPTION

Figure 1:
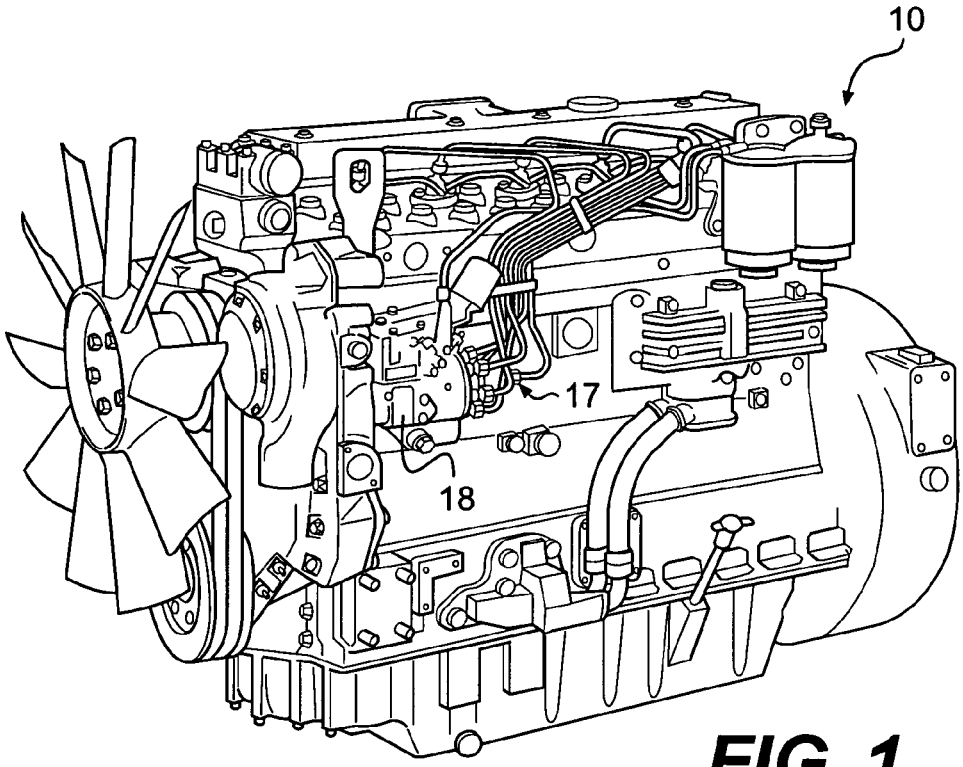
FIG. 1 shows an isometric representation of an internal combustion engine.
Figure 2:
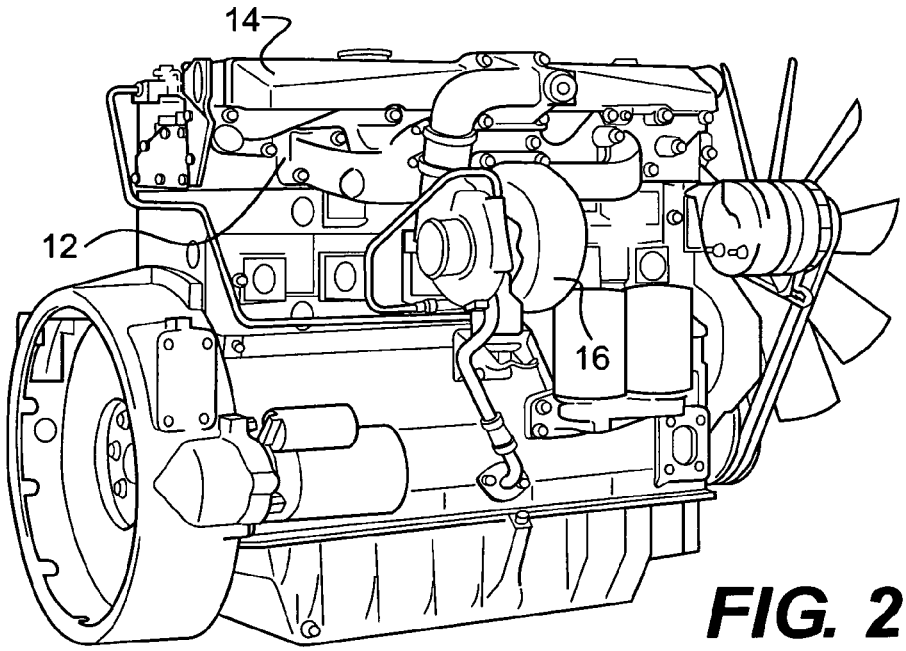
FIG. 2 shows a further isometric representation of the internal combustion engine of FIG. 1.

Now referring to FIGS. 1 and 2, an engine generally designated with numeral 10 is shown for exemplary purposes only. The engine 10 may for example be any suitable internal combustion engine such as a multi-cylinder turbocharged diesel engine. In one embodiment the engine 10 may be provided with an exhaust manifold 12, an inlet manifold 14 and a turbocharger arrangement 16. The turbocharger arrangement 16 may operate in a conventional manner such that at least a portion of exhaust gas expelled by the engine 10 flows from the exhaust manifold 12 towards the turbocharger arrangement. The exhaust gas may drive the turbocharger arrangement which in turn may then provide fresh air to the inlet manifold 14.

The engine 10 may further be provided with a fuel system generally designated with numeral 17, having a fuel injection pump 18 (FIP) which may be any suitable fuel injection pump such as a rotary or in-line mechanical fuel pump. The fuel injection pump 18 may provide fuel to any number of cylinders (not shown) of the engine 10 in a conventional manner such as via rigid fuel pipe and injector arrangements.

Figure 3:
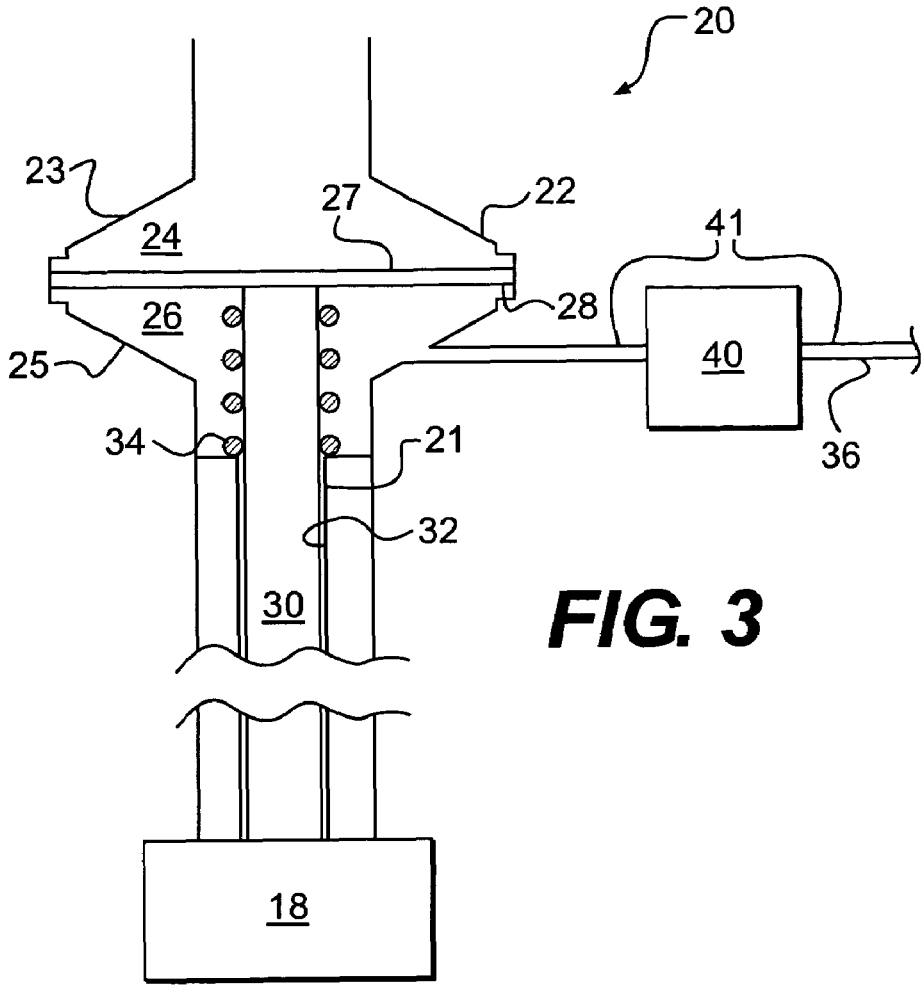
FIG. 3 is a schematical cross-sectional view of an exemplary boost control arrangement for use in conjunction with the internal combustion engine of FIGS. 1 and 2.

The FIP 18 may be provided with a boost control arrangement 20 (BCA) of which an exemplary embodiment is shown in FIG. 3. In one embodiment the BCA 20 may have a housing 22 defining two regions in the form of a first chamber 24 and a second chamber 26. The housing 22 may be of any suitable construction and may for example be a two part housing whereby a first part 23 of the housing 22 may predominantly form the first chamber 24 and a second part 25 of the housing 22 may predominantly form the second chamber 26.

The first and second chambers 24, 26 may be divided or separated by a moveable member 27. The moveable member 27 may be a piston or the like and in one embodiment the moveable member 27 may be a flexible member such as a diaphragm. In the case that the moveable member 27 is a diaphragm, the moveable member 27 may be arranged such that a flange portion 28 of the moveable member 27 is clamped in between the first and second parts 23 and 25 of the housing 22. An actuator 30 may be operably connected to the moveable member 27 such that movement of the moveable member 27 results in movement of the actuator 30. The actuator 30 may be generally pin shaped and may be guided and or retained in a bore 32. The actuator 30 may be operably connected with a metering portion (not shown) of the FIP 18 such that any movement of the actuator 30 may result in a changed setting of the FIP 18. The actuator may be connected with a portion of the FIP 18 that contains pressurized fuel. The fuel may be at any suitable pressure such as for example FIP housing pressure. The clearance between the actuator 30 and the bore 32 may be selected as preferred and may be configured to act as a fuel passage 21 so as to allow the transfer of fuel from the FIP 18 to the second chamber 26.

A resilient member 34, such as for example a spring, may be arranged in the second chamber 26 so as to bias the moveable member 27 towards the first chamber 24. The resilient member 34 may be arranged substantially central in the second chamber 26 such that the resilient member 34 surrounds at least a portion of the actuator 30. Pressurized fuel in the second chamber 26 may also bias moveable member 27 towards the first chamber 24. It is to be understood that the moveable member 27 may be biased towards the first chamber 24 by just the resilient member 34, just fuel pressure in the second chamber 26 or a combination thereof.

The second chamber 26 may be fluidly connected with another region such as a fluid holding region 36. The fluid holding region 36 may be any suitable region such as another chamber (not shown) or a return line to tank 36 and may be at any suitable pressure either positive, negative or neutral. It is to be understood that the fluid holding region does not imply the fluid is static, the fluid holding region may for example also include a transfer passage. In one embodiment the fluid holding region 36 is substantially pressureless.

Interposed between the second chamber 26 and the fluid holding region 36 there may be provided a fluid flow control arrangement 40 which may be fluidly connected to the second chamber 26 and the fluid holding region 36 by a passage 41. The fluid flow control arrangement 40 may be configured such that it is capable of influencing the flow rate of fuel between the second chamber 26 and the fluid holding region 36. The fluid flow control arrangement 40 may be configured such that it includes geometric flow control features such that the discharge coefficient for fluid flow in one direction is substantially different to the discharge coefficient for fluid flow in the opposite direction.

Figure 4:
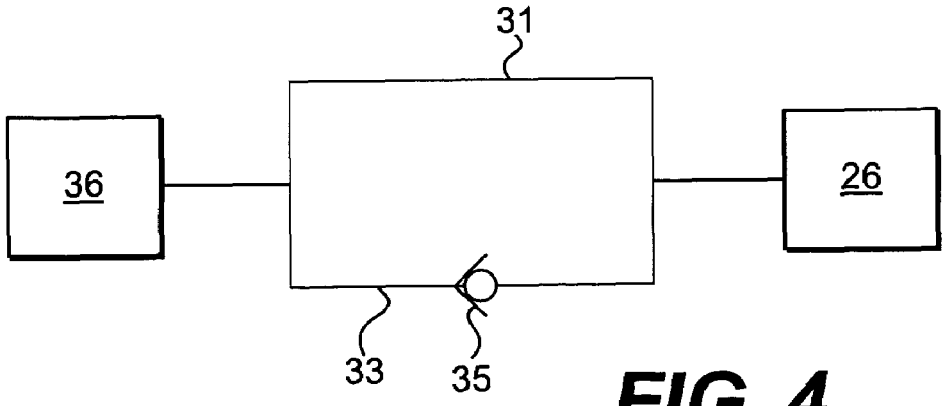
FIG. 4 is a diagrammatic representation of a fluid circuit for use in conjunction with the boost control arrangement of FIG. 3.

In one embodiment the fluid flow control arrangement 40 may be configured such that it defines a first cross-sectional fluid flow area to allow a first fuel flow from the second chamber 26 to the fluid holding region 36 and a second cross-sectional fluid flow area to allow a second fuel flow from the fluid holding region 36 to the second chamber 26, whereby the second cross-sectional fluid flow area may be greater than the first cross-sectional fluid flow area. Such relationship may for example be expressed in a fluid diagram as shown in FIG. 4. When fluid flows from the fluid holding region 36 to the second chamber 26, fluid can flow both through the first passage 31 and the second passage 33. However, when the fluid flows from the second chamber 26 to the fluid holding region 36, the valve 35 which in this example is shown as a one-way shuttle valve, may be at least partially closed off so as to at restrict the flow through the passage 33. Restricting in this context may be interpreted as the fluid either being hindered or blocked altogether. The valve may be of any suitable design. In one embodiment the valve 35 is self-adjusting in that it is responsive to a fluid flow and may react to the fluid flow without any external input, i.e. it is capable of adjusting its own position under the influence of a fluid flow. It can be seen that the cross-sectional fluid flow area is greater when the fluid flows from the pressure region 36 to the second chamber 26, because both the passages 31 and 33 are fully open or at least more so than in the opposite direction. It is to be understood that the passage 31 may be sized so as to act as a restrictor or it may be provided with a restrictor such as an orifice so as to be able to tailor standardized bodies with suitable orifices.

Figure 5:
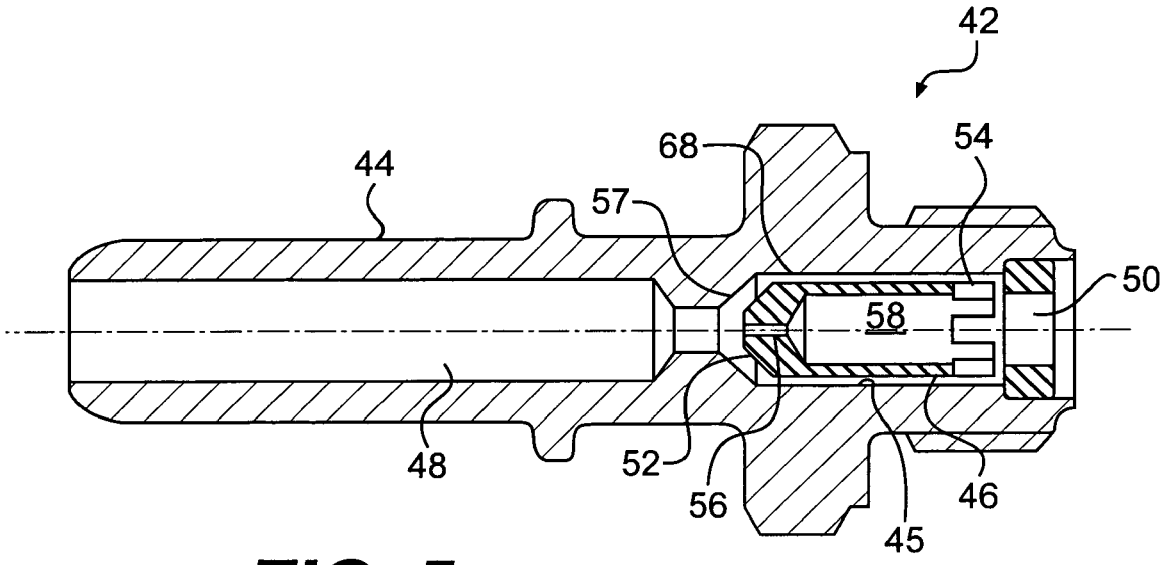
FIG. 5 is a schematical cross-sectional view of an embodiment of a fluid flow control arrangement for use in conjunction with the boost control arrangement of FIG. 3.

In one embodiment the fluid flow control arrangement 40 may include a valve arrangement of which an exemplary embodiment is shown in FIG. 5. A valve arrangement generally designated with numeral 42 may have a housing 44. The housing 44 may be a single piece construction or may be constructed from multiple pieces. A valve member 46 may be slidingly engaged with said housing. For ease of reference the housing 44 will be described as having a first passage portion 48 and a second passage portion 50 whereby the first passage portion 48 is that portion which is located left from the valve member 46 as seen in FIG. 5 It follows that the second passage portion 50 is that portion which is located right from the valve member 46 as seen in FIG. 5. It is to be understood that the exact boundaries of the first and second portions 48 and 50 are relative and depend on the position of the valve member 46.

Figure 6:
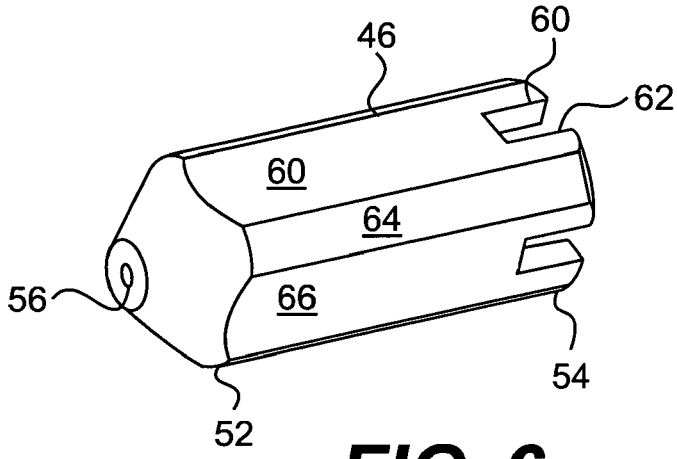
FIG. 6 is an isometric diagrammatical representation of a valve member of the fluid flow control arrangement of FIG. 5.

One embodiment of a valve member 46 is show in more detail in FIG. 6. The valve member 46 may be manufactured as a single piece component. A first end portion 52 may be tapered so as to form a generally conical shaped nose portion that corresponds to a counter surface 57 of the housing 44. The first end portion 52 may be provided with a longitudinal fluid passage 56 fluidly connecting a chamber 58 of the valve member 46 to the first passage portion 48. A second end portion 54 may be provided with at least one radial fluid opening 60 fluidly connecting the chamber 58 to the second passage portion 50. In one embodiment the fluid openings may for ease of manufacturing be formed as slots 62 in the second end portion 54 so as to create a castellated end portion 54. However, any suitable alternative to connect the chamber 58 with the environment external of the valve member 46 may be chosen such as, for example, round passages formed by casting, moulding, sintering or a machining operation such as drilling. The valve member 46 may have a substantially circumferential shape as preferred. In one embodiment, the valve member may be provided with at least one surface 66 and at least one convex surface 64. The convex surface 64 may be regarded as a positioning surface so as to position the valve member 46 relative to the body 44. The surface 66 may be less convex than the convex surface 64 and may be for example be substantially flat or substantially concave. When the valve member 64 is engaged with the housing 44 the convex surface 64 may be spaced more closely to the internal wall 45 of the housing 44 than the surface 66. The housing 44 and the surface 66 may therefore form a passage 68 external of the valve member 46 capable of allowing fluid to transfer between the first end portion 52 and the second end portion 54. In this embodiment the passage 56 may perform the function of the passage 31 whilst the passage 68 may perform the function of the passage 33. Whenever the valve member is in the position such that the first end portion 52 is close to, or contacts the corresponding counter surface 57, the passage 68 may be at least partially blocked off and may therefore perform the function of the valve 35.

Alternatively a passage equivalent in function to passage 68 or 33 may be predominantly or completely formed in or by the body 44 rather than being predominantly formed by the surface 66 being spaced away from a surface of the body 44.

It is to be understood that this valve arrangement may be regarded as self-adjusting as referred to above.

INDUSTRIAL APPLICABILITY

During use, the engine 10 operates in a conventional manner. The FIP 18 supplies fuel to the engine 10 which may be combusted with air supplied via the inlet manifold 14. After combustion the exhaust gasses may be vented via the exhaust manifold 12. The turbocharger arrangement 16 may be driven by the exhaust gasses flowing from the exhaust manifold 12. The turbocharger arrangement 16 may in turn then pressurize air in the inlet manifold 14.

During operation a request for a modification of a first flow of fuel to at least one combustion chamber may be received. For example, the engine 10 may be in a boost condition which may be described as a condition in which relatively large increase of power output of the engine 10 is requested in a relatively short period of time. This may for example happen when during operation of a work machine, the operator requests an increase in power output of the engine 10 by actuating a machine function such as for example moving an accelerator pedal or hand throttle (not shown) from a first position corresponding to a lower engine speed to a second position corresponding to a higher engine speed. In response to the request for the modification of the first flow of fuel the first flow of fuel may be modified. In such circumstances it is possible that the rate of increase of the fuel that is injected for combustion is higher than the rate of increase in the quantity of air required for a satisfactory combustion, i.e. the air-to-fuel ratio is not as well controlled as desired. The rate of increase in the quantity of air may be expressed via an indicative signal. For example, the gas pressure in one of the inlet manifold 14 and the exhaust manifold 12 may be used to receive a signal indicative of an air supply condition such as the amount of air available for combustion. In one embodiment the signal relates specifically to the gas pressure in the inlet manifold 14. The signal may be generated in any form such as for example an electric signal generated by a sensor which may then be sent to, and received by, the BCA 20 either in a direct or indirect manner. In one embodiment the signal may be provided by having the BCA 20 fluidly communicate with a manifold such as the inlet manifold 14, such that the BCA 20 may receive a gas pressure corresponding to the gas pressure in the inlet manifold 14. The gas pressure may be received by the first chamber 24 and may act upon the moveable member 27 so as to displace the moveable member 27. Displacing in this context may be interpreted as displacing at least a portion of the moveable member 27. The moveable member 27 may in turn displace the actuator 30 such that the actuator 30 or another related mechanism influences the metering or output of the FIP 18. It can therefore be seen that a signal corresponding to a higher gas pressure may influence the FIP 18 more than a signal corresponding to a lower gas pressure.

During a request for increase of power output of the engine 10, the FIP 18 may increase its output in direct relationship to the request, for example, moving an accelerator pedal or hand throttle may directly increase the fuel output of the FIP 18. In addition, the BCA 20 may increase the rate of fuelling even further in response to a signal indicative of a boost condition in which sufficient air is available to burn additional fuel in an acceptable manner.

To balance the BCA 20, the resilient member 34 may bias the moveable member to the first chamber 24. An increased signal generated by the gas pressure may therefore overcome the force provided by the resilient member 34 and the resilient member 34 may be compressed. If the resilient member is a spring, the relationship of force and compression may be substantially linear which therefore leads to a substantially linear counteracting force to the signal as transferred by the moveable member 27.

The second chamber 26 of the BCA 20 may be provided with fuel that flows from the FIP 18 via the passage 21 between the actuator 30 and the bore 32. The passage 21 may be relatively small which may therefore result in the second chamber 26 being filled at a relatively low rate. During operation a first signal may arrive at the BCA 20 whereby the signal may be indicative of a first air supply condition such as a first boost condition. This may for example be a condition wherein a sharp increase of power output from the engine 10 is requested. The signal may in case of a BCA 20 having a moveable member 27, displace the moveable member 27 against the resistance offered by the resilient member 34. The displacement of the moveable member 27 increases the fluid pressure in the second chamber 26. Not all of the fluid present in the second chamber 26 may be able to escape back to the FIP 18 via the passage 21 due to the passage 21 being relatively small. The pressurized fluid in the second chamber 26 may then be displaced as a second flow of fuel towards the fluid holding region 36 via the passage 41 and the fluid flow control arrangement 40. It is therefore to be understood that the second flow of fuel is displaced in response to receiving the signal. As described above, the fluid flow control arrangement 40 may be provided with a particular first cross-sectional fluid flow area to allow a first fuel flow rate from the second chamber 26 to the fluid holding region 36. Therefore when the moveable member 27 displaces the fluid from the second chamber 26 towards the fluid holding region 36 the rate of the fuel escaping the second chamber 26 may be tailored such that an additional resistance is provided to the moveable member 27 in conjunction with the resilient member. The rate of displacement of the moveable member 27 is therefore dependent on the resistance as offered by the resilient member 27 which may be substantially linear and the resistance as offered by the displacement of the fluid over the fluid flow control arrangement 40 which may be substantially non-linear. Hence by sizing the passage 31 a non-linear resistance to displacing the fluid may be selected. The displacement may for example be influenced by forcing the fluid to flow through an orifice. By influencing the rate of adjustment of the metering portion of the FIP 18 it is possible to tailor the increase of fuel as provided by the FIP 18 for combustion in relation to the air available for combustion, i.e. the modification of the first flow of fuel is controlled by the displacement of the second flow of fuel. The restriction as offered by the fluid flow control arrangement 40 may also be tailored to different engine applications such as for example heavy duty agricultural work, light duty construction work etc.

During operation a second signal may be received by the BCA 20 whereby the signal may be indicative of a second air supply condition such as for example a second boost condition wherein a request for a sharp increase of power output from the engine 10 is interrupted. This may be related to the first signal such that the second signal is indicative of a second gas pressure, whereby the first gas pressure is higher than the second gas pressure. In this condition the resistance offered by the resilient member 34 and any fluid pressure in the chamber 26 may force the moveable member 27 back towards the first chamber 24. It is desirable to replace the fluid previously displaced from the second chamber 26 so as to prepare the second chamber for the next event similar to the first boost condition. However, due to the passage 32 being relatively small and incapable of rapidly providing a sufficient quantity of fuel, there is a risk of the second chamber being only partially refilled when the next event commences. This may be undesirable and at least a portion of the fluid that was previously displaced into the passage 41 may return to refill the second chamber 26 so as to replace the previously displaced fluid. Because a rapid refill is desirable it may be preferred to provide an increased discharge coefficient or increased cross-sectional flow area, such as an additional passage, that allows an unhindered or less restricted flow of fluid towards the second chamber. Hence during the second boost condition fuel can flow from the pressure region 36 towards the second chamber 26 via the passage 33, but additionally it can flow through the passage 33 and the valve 35. By allowing fuel to flow back through both the passages 31 and 33 a greater fuel flow cross-sectional area is provided enabling a higher rate of fuel flow into the second chamber 26 as compared to allowing the fuel to flow just through the passage 31.

In an embodiment using the valve arrangement 42 as shown in FIGS. 5 and 6 the process may be as follows. During a first boost condition the fluid may flow from the second passage portion 50 to the first passage portion 48. The flow acts upon the valve member 46 such that the valve member assumes a first position such that the first end portion 52 and the counter surface 57 may come together thereby restricting the passage 68 which is equivalent to restricting the passage 33 as shown in FIG. 4. Restricting in this context may be interpreted as a partial or total closing of at least one passage. Hence most or all of the fluid may then flow from the second passage portion 50 through the chamber 58 and the longitudinal fluid passage 56 towards the first passage portion 48. During a second boost condition the fluid may flow from the first passage portion 48 to the second passage portion 50. The flow acts upon the valve member 42 such that the valve member 46 is forced in a direction which is generally away from the first passage portion 48, thereby assuming a second position and opening, or further opening the passage 68. In this case fluid may flow from the first passage portion 48 to the second passage portion 50 via the longitudinal fluid passage 56 and the chamber 58. In addition the fluid may flow from the first passage portion 48 to the second passage portion 50 via the passage 68, the radial fluid opening 60 and again the chamber 58.

It will be apparent to those skilled in the art that various modifications and variations can be made to the disclosed system. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. A fuel system for an internal combustion engine, comprising:

a boost control arrangement operably connectable to a fuel injection pump, said boost control arrangement having a first chamber and a second chamber separated from said first chamber by a moveable member, said first chamber being configured to receive a signal indicating a boost condition of the internal combustion engine, said second chamber being configured to contain fuel;

a fluid holding region fluidly connected with said second chamber, wherein the fluid holding region is configured to be substantially pressureless; and a fluid flow control arrangement between said second chamber and said fluid holding region for controlling the flow rate of fuel between said second chamber and said fluid holding region.

2. A fuel system according to claim 1, wherein the fluid flow control arrangement includes geometric flow control features such that a discharge coefficient for fluid flow in one direction is substantially different than a discharge coefficient for fluid flow in the opposite direction.

3. A fuel system according to claim 1, wherein said fluid flow control arrangement defines a first cross-sectional fluid flow area to allow a first fuel flow from the second chamber to the fluid holding region and a second cross-sectional fluid flow area to allow a second fuel flow from the fluid holding region to the second chamber, said second cross-sectional fluid flow area being greater than said first cross-sectional fluid flow area.

4. A fuel system according to claim 1, wherein said moveable member is operably connected with an actuator for actuating a metering portion of the fuel injection pump.

5. A fuel system according to claim 4, wherein said actuator is generally pin shaped and is housed at least partially in a bore, whereby a space between said actuator and said bore forms a fuel passage configured to provide fuel to said second chamber.

6. A fuel system according to claim 1, wherein a resilient member biases said moveable member towards said first chamber.

7. A fuel system according to claim 1, wherein fuel pressure biases said moveable member towards said first chamber.

8. A fuel system according to claim 1, wherein said fluid flow control arrangement includes a valve arrangement for controlling flow rates into and out of the boost control arrangement, said valve arrangement comprising:

a housing having a first passage portion and a second passage portion;

a self-adjusting valve member slidingly engaged with said housing and positioned between said first passage portion and said second passage portion, said valve member having a first fluid passage fluidly connecting said first passage portion and said second passage portion of said housing;

a second passage capable of fluidly connecting said first passage portion and said second passage portion of said housing;

said housing and said self-adjusting valve member being configured such that said self-adjusting valve member can adopt a position relative to said housing whereby in said position said second passage is restricted.

9. A fuel system according to claim 8, wherein said self-adjusting valve member is configured to adjust its position under the influence of a fluid flow.

10. A fuel system according to claim 8, wherein said first fluid passage is internal to said self-adjusting valve member.

11. A fuel system according to claim 8, wherein said at least one second fluid passage is external to said self adjusting valve member.

12. A fuel system according to claim 1, wherein the fluid holding region is a return line to tank.

13. A method of controlling an air to fuel ratio of an internal combustion engine comprising:

receiving a request for a modification of a first flow of fuel to at least one combustion chamber;

modifying said first flow of fuel in response to said request;

receiving a first signal indicative of a first air supply condition;

displacing a second flow of fuel in response to said first signal; and controlling said modification of said first flow of fuel by said displacement of said second flow of fuel towards a fluid holding region, wherein the fluid holding region is configured to be substantially pressureless.

14. A method according to claim 13, wherein displacing said second flow of fuel takes place at a first flow rate and the method further includes replacing the fluid displaced in said second flow of fuel at a second flow rate different than said first flow rate.

15. A method according to claim 14, wherein replacing the fluid displaced in said second flow of fuel at the second flow rate different than said first flow rate takes place in response to receiving a second signal indicative of a second air supply condition.

16. A method according to claim 15, wherein receiving said first signal includes receiving a signal indicative of a first boost condition of said internal combustion engine and receiving said second signal includes receiving a signal indicative of a second boost condition of said internal combustion engine.

17. A method according to claim 15, wherein said first signal is indicative of a first gas pressure and said second signal is indicative of a second gas pressure, whereby said first gas pressure is higher than said second gas pressure.

18. A method according to claim 13, further including restricting the displacement of said second flow of fuel so as to control the first flow rate.

19. A method according to claim 13, further including adjusting a metering portion of a fuel injection pump in response to receiving said first signal whilst substantially simultaneously displacing said second flow of fuel.

20. A method according to claim 18, wherein restricting the displacement of said second flow of fuel includes restricting the displacement of the second flow of fuel so as to influence the rate of adjustment of the metering portion of said fuel pump.

21. A method according to claim 14, wherein replacing said displaced fluid includes allowing at least a portion of the displaced fluid to return.

22. A method according to claim 13, including moving a valve member from a first position to a second position in response to the fluid being displaced thereby restricting at least one fluid passage.

23. A method according to claim 21, including moving a valve member from a second position to a first position in response to the fluid being allowed to return thereby opening at least one fluid passage.

24. A method according to claim 22, wherein moving said valve member includes allowing said valve member to self-adjust under the influence of a fluid flow.

25. A method according to claim 17, including displacing a moveable member with said gas pressure, said moveable member in turn acting upon a fluid so as to displace said second flow of fuel.

26. A method according to claim 25, including compressing a resilient member by displacing said moveable member.

* * * * *